United States Patent [19]

Guice

[11] 4,133,255

[45] Jan. 9, 1979

[54] PAINT SPRAY BOOTH AND METHOD OF PAINTING AN ARTICLE THEREIN

[76] Inventor: John J. Guice, 5470 Pensacola Blvd., Pensacola, Fla. 32505

[21] Appl. No.: 779,491

[22] Filed: Mar. 21, 1977

[51] Int. Cl.[2] ..... F23J 11/00

[52] U.S. Cl. ..... 98/115 SB; 55/DIG. 29; 118/DIG. 7; 118/326; 118/634

[58] Field of Search ..... 98/36, 115 R, 115 SB; 55/DIG. 29; 118/DIG. 7, 326, 634

[56] References Cited

U.S. PATENT DOCUMENTS

| | | | |
|---|---|---|---|
| 1,502,844 | 7/1924 | Bingman | 98/115 SB |
| 1,750,774 | 3/1930 | Fahlstrom | 98/115 SB |
| 3,380,369 | 4/1968 | Allander | 98/36 |
| 3,391,630 | 7/1968 | Wilhelmsson | 98/115 SB |
| 3,626,837 | 12/1971 | Pelosi, Jr. et al. | 98/36 |
| 3,776,121 | 12/1973 | Truhan | 98/36 |

FOREIGN PATENT DOCUMENTS

| | | | |
|---|---|---|---|
| 992682 | 5/1965 | United Kingdom | 98/115 SB |

*Primary Examiner*—Ronald C. Capossela
*Attorney, Agent, or Firm*—Woodford R. Thompson, Jr.

[57] ABSTRACT

A closed paint spray booth and method of spray painting an article therein which air inlet means is provided around the upper perimeter of the booth. Air exhaust means along lower portions of upstanding walls for the booth withdraws paint laden air from the booth. Inlet air is directed inwardly of the spray booth in position to be drawn downwardly and around the object being painted to define an air curtain around the object which is then drawn outwardly away from said object to the air exhaust means.

1 Claim, 3 Drawing Figures

PAINT SPRAY BOOTH AND METHOD OF PAINTING AN ARTICLE THEREIN

BACKGROUND OF THE INVENTION

This invention relates to a paint spray booth and method of painting an article therein and more particularly to such a booth which shall be adapted for painting vehicles, such as automobiles, therein.

As is well known in the art to which my invention relates difficulties have been encountered in painting articles, such as automobiles, due to the fact that the air flow through the booth has been in a generally horizontal direction toward the article being painted whereby there is a turbulent flow of air over the floor of the spray booth which entrains dust particles and the like picked up from the floor of the booth. This is a big problem encountered with a conventional booth having horizontal flow of air due to the fact that the vehicle tires deposit dirt on the floor of the booth and heretofore it has not been possible to prevent the exhaust fan from drawing some of the dirt from the floor and depositing it onto the freshly painted surface.

Another problem encountered in conventional spray booths has been the lack of protection to the painter. Although the paint operator usually wears a protective mask when applying paint, the operator is still exposed to a considerable amount of paint laden air in conventional paint booths.

The patents to Dock et al U.S. Pat. Nos. 3,168,029, Wilhelmsson et al 3,168,030, Krontz et al 3,170,384 and Roberts 3,807,291 show conventional type spray booths wherein the air is removed through the floor of the booth beneath the article being painted. Also, the McCue U.S. Pat. No. 2,445,074 discloses a conventional spray booth wherein air passes through filters located in the doors of the booth.

SUMMARY OF THE INVENTION

In accordance with my invention, I provide a closed paint spray booth in which inlet air is introduced around the upper perimeter of the spray booth. Paint laden air is removed along the lower portion of the side walls of the booth adjacent the floor whereby the inlet air is drawn into the spray booth. The inlet air is directed inwardly of the booth in position to first form a downwardly flowing curtain of air around the object being painted which then flows outwardly away from the article being painted to exhaust. The air is thus drawn downwardly around the article being painted and toward the floor and then outwardly away from the article being painted toward the side walls of the booth where the paint laden air is removed. Accordingly, as the inlet air is introduced around the upper perimeter of the spray booth, there is a uniform, downwardly flow of air over and around the automobile which is then discharged more rapidly due to the fact that the paint laden air has a short distance to travel to discharge, thereby greatly improving the working environment due to the fact that the air is cleaner and the painting conditions are more desirable. That is, with my improved booth, the paint laden air travels less than half the distance that it does in conventional spray booths with which I am familiar. With my improved spray booth, the exhaust air does not lift dirt from the floor and deposit the same onto the freshly painted surface of the article being painted due to the fact that the paint laden air is directed toward the floor and then away from the article being painted. Furthermore, with my improved booth, the incoming air is deflected to form a downwardly moving air curtain which moves the paint laden air away from the walls of the spray booth whereby the walls and lights of the booth are maintained in a clean condition.

DESCRIPTION OF THE DRAWINGS

A spray booth embodying features of my invention and which may be employed to carry out my improved method is shown in the accompanying drawings, in which.

DETAILED DESCRIPTION

Figure 1:
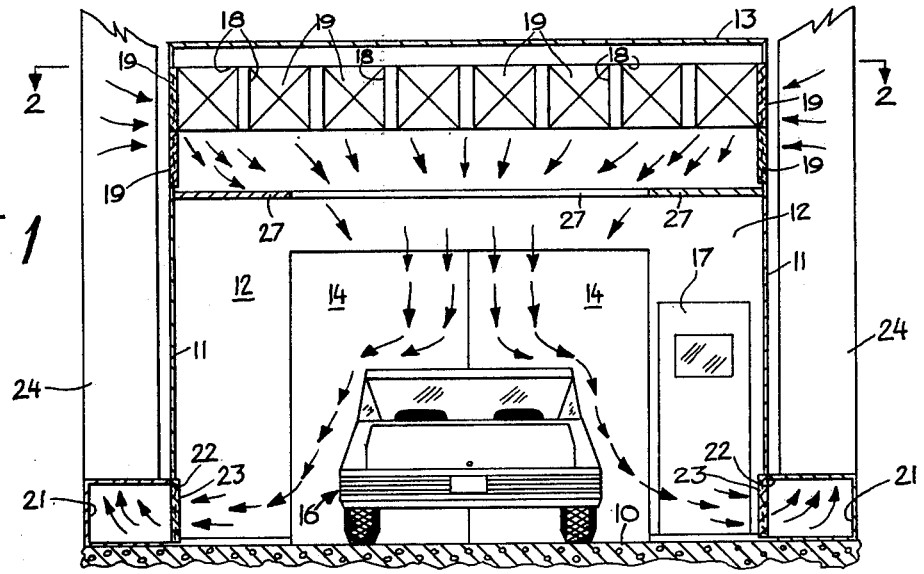
FIG. 1 is a vertical sectional view taken generally along the line 1—1 of FIG. 2.

Referring now to the drawings for a better understanding of my invention, I show a closed paint spray booth having a floor 10, upstanding side walls 11, upstanding end walls 12 and a ceiling 13. The end walls 12 may be provided with suitable doors 14 at opposite ends of the booth for passing a vehicle to be painted, such as an automobile 16. Also, an access door 17 may be provided in one end wall 12, as shown in FIG. 1.

Air inlet passageways 18 are provided around the upper perimeter of the spray booth, as shown, whereby inlet air is supplied around the entire upper perimeter of the booth. Suitable air filters 19 are provided in the inlet passageways 18 whereby the air drawn in through the passageways 18 is filtered to remove foreign particles, such as dust and the like.

Figure 2:
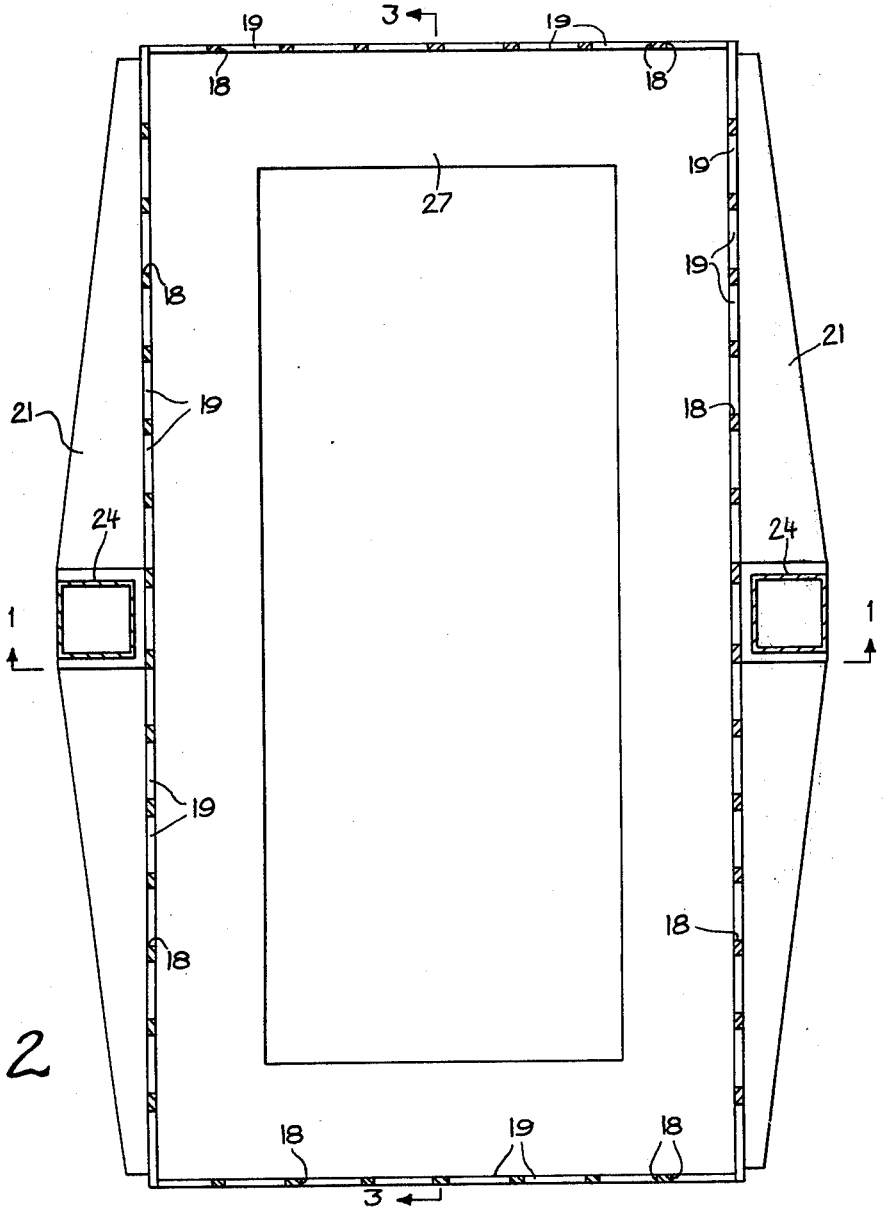
FIG. 2 is a horizontal, sectional view taken generally along the line 2—2 of FIG. 1.
Figure 3:
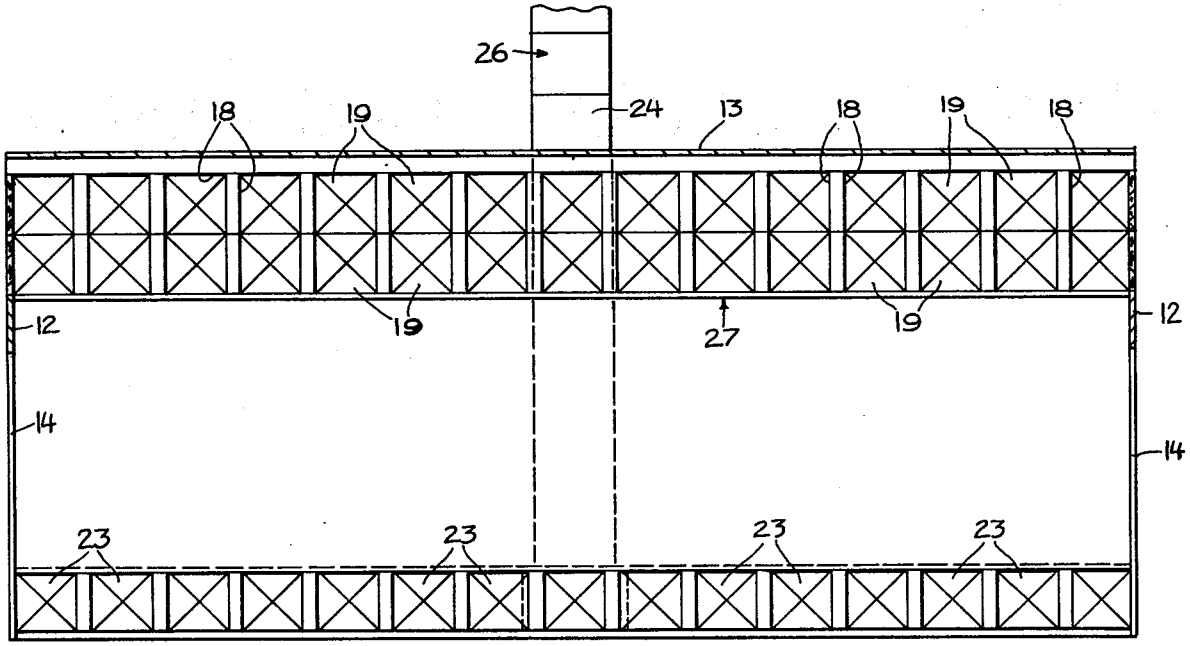
FIG. 3 is a vertical sectional view taken generally along the line 3—3 of FIG. 2.

As shown in FIGS. 1 and 2, air exhaust chambers 21 are provided along the lower portion of each side wall 11 for withdrawing paint laden air from the spray booth. The air exhaust chambers 21 are provided with a plurality of air exhaust openings 22 which communicate with the interior of the spray booth. As shown in FIGS. 1 and 3, a paint arrestor unit 23 is mounted in each air exhaust opening 22, which is at the entrance to the air exhaust chamber 21 adjacent thereto. Communicating with each air exhaust chamber 21 is an upstanding exhaust duct 24. As shown in FIG. 3, a suitable exhaust fan unit 26 is provided in each exhaust duct 24. In view of the fact that the air arrestor units 23 and the exhaust fan unit 26 are conventional units, well known in the art to which my invention relates, no further description thereof is deemed necessary.

As shown in FIGS. 1 and 2, a baffle member 27 projects laterally and inwardly of the side walls 11 and 12 at an elevation subjacent the air inlet passageways 18 and the filter units 19. As further shown in FIG. 1, the baffle member 27 extends inwardly a distance to direct the inlet air inwardly of the spray booth in position to first form a downwardly flowing curtain of air around the vehicle 16 being painted whereupon the air is then drawn outwardly away from the vehicle 16 to the paint arrestors 23. The path of movement of the air from the inlet passageways 18 to the paint arrestors 23 is indicated by arrows in FIG. 1. It will thus be seen that as the air enters the spray booth through the filters 19 it is first drawn downwardly in a generally vertical direction around the object 16 being painted and then is drawn outwardly away from the object 16 toward the paint arrestors 23.

From the foregoing, it will be seen that I have devised an improved paint spray booth which is particularly adapted for painting articles such as vehicles. By introducing inlet air around the entire upper perimeter of the spray booth and filtering the air as it enters the booth, clean air is continuously supplied to the spray booth whereby there is a uniform flow of air into the booth. By providing the baffle means for directing the incoming air inwardly whereby it then flows downwardly to form an air curtain around the article 16 being painted, I reduce to a minimum the accumulation of paint build-up on the lights and walls of the paint booth. By directing the paint laden air downwardly around the vehicle 16 toward the floor and then outwardly toward the paint arrestors 23, the movement of the air near the floor is always away from the vehicle and at the same time no air is forced beneath the undercarriage of the vehicle. This eliminates the possibility of the paint laden air creeping underneath the vehicle and being deposited in a foggy film on parts of the vehicle that should not be coated, such as the engine, accessories, electrical system and various adjoining parts. Also, by forming the curtain of air around the vehicle being painted and then removing the paint laden air immediately through the paint arrestors 23, the paint laden air travels a very short distance to the exhaust means and at the same time the paint laden air is drawn downwardly away from the face of the operator. The paint laden air is thus discharged more rapidly because it has less distance to travel, thereby making the working environment cleaner and more desirable. Furthermore, by introducing the inlet air in a uniform manner around the upper perimeter of the booth and causing the curtain of air around the vehicle to move outwardly in a uniform manner toward the paint arrestors 23, I eliminate any turbulent flow of air over the floor toward the vehicle being painted, thereby preventing dust, dirt and the like from being drawn upwardly from the floor and deposited on the freshly painted surface of the article being painted.

While I have shown my invention in but one form, it will be obvious to those skilled in the art that it is not so limited but is susceptible of various changes and modifications without departing from the spirit thereof.

What I claim is:

1. In a closed paint spray booth for painting an object therein and having a floor and upstanding walls, the improvement comprising:

(a) air inlet means around the entire upper perimeter of said side walls of said spray booth for introducing a uniform flow of filtered air into said spray booth, (b) air exhaust means along the lower portion of said walls adjacent said floor for withdrawing paint laden air from said spray booth near said floor, and (c) a continuous, horizontal baffle member subjacent said air inlet means extending inwardly of and around said spray booth and terminating inwardly thereof at a distance to define a single centrally disposed open space inwardly of said baffle member with said baffle member directing all of the air passing through said air inlet means inwardly of said baffle member and away from said upstanding walls of said spray booth in position to be first drawn downwardly by said air exhaust means onto and around said object being painted in a generally vertical direction and then be in position to be drawn by said air exhaust means outwardly in a uniform manner away from said object being painted and superjacent said floor to said air exhaust means.

* * * * *